US008966762B2

(12) United States Patent
Soni

(10) Patent No.: US 8,966,762 B2
(45) Date of Patent: Mar. 3, 2015

(54) HOLLOW JEWELRY

(75) Inventor: Arvind Soni, Mumbai (IN)

(73) Assignee: Jewelex India Pvt. Ltd., Mumbai, Andheri (East) (IN)

( * ) Notice: Subject to any disclaimer, the term of this patent is extended or adjusted under 35 U.S.C. 154(b) by 620 days.

(21) Appl. No.: 13/120,007

(22) PCT Filed: Nov. 19, 2008

(86) PCT No.: PCT/IN2008/000776

§ 371 (c)(1),
(2), (4) Date: May 10, 2011

(87) PCT Pub. No.: WO2010/032255

PCT Pub. Date: Mar. 25, 2010

(65) Prior Publication Data

US 2012/0118015 A1 May 17, 2012

(30) Foreign Application Priority Data

Sep. 22, 2008 (IN) ..... 2024/MUM/2008

(51) Int. Cl.

| | |
|---|---|
| ***A44C 27/00*** | (2006.01) |
| ***A44C 9/00*** | (2006.01) |
| ***B22C 7/02*** | (2006.01) |
| ***B22C 9/04*** | (2006.01) |
| ***B22D 25/02*** | (2006.01) |

(52) U.S. Cl.

CPC . *A44C 27/00* (2013.01); *A44C 9/00* (2013.01); *B22C 7/02* (2013.01); *B22C 9/04* (2013.01); *B22D 25/026* (2013.01)

USPC ..... 29/896.412; 29/896.4; 29/896.41

(58) Field of Classification Search

CPC ..... A44C 27/00; A44C 17/02; A44C 17/04; A44C 9/00; A44C 15/00; B21D 53/44

USPC ..... 29/896.4, 896.41, 896.412, 896.43, 10, 29/469.5, 525.01, 525.13, 525.14, 525.15, 29/527.1; 63/3, 15

See application file for complete search history.

(56) References Cited

U.S. PATENT DOCUMENTS

| | | | |
|---|---|---|---|
| 3,991,809 | A | 11/1976 | Voegele |
| 4,343,684 | A | 8/1982 | Lechtzin |
| 5,172,568 | A | 12/1992 | Senanayake |
| 5,606,873 | A | 3/1997 | Zeller et al. |
| 5,718,278 | A | 2/1998 | Baum |
| 6,453,699 | B1 | 9/2002 | Hashimian et al. |
| 6,467,526 | B1 | 10/2002 | Cope |
| 6,554,052 | B2 | 4/2003 | Hashimian et al. |

FOREIGN PATENT DOCUMENTS

JP 2001 334348 A 12/2001

OTHER PUBLICATIONS

International Search Report and Written Opinion from International Application No. PCT/IN2008/000776 dated Jun. 8, 2009.

*Primary Examiner* — Ryan J Walters
(74) *Attorney, Agent, or Firm* — Alston & Bird LLP

(57) ABSTRACT

The present invention relates to a process to produce hollow jewelry article and hollow jewelry articles produced in accordance with the said process. The process comprises a joining least two predetermined wax portions into a wax model and casting the said wax model into a partially or fully hollow jewelry article.

6 Claims, 7 Drawing Sheets

HOLLOW JEWELRY

FIELD OF THE INVENTION

The present invention relates to a process to produce hollow jewelry article and hollow jewelry articles produced in accordance with the said process. More particularly, there is provided a method or process for fabricating a hollow jewelry article by joining at least two predetermined wax portions into a wax model and casting the said wax model into a partially or fully hollow jewelry article.

BACKGROUND & PRIOR ART

The present invention relates to a process of manufacturing hollow jewelry.

There are many well known processes used in the large volume production of jewelry. Such processes include die striking, casting and electroforming, all of which are used for producing metallic jewelry articles. Such production methods are capable of facilitating high volume, high speed production with very good reproducibility.

Jewelry articles are most commonly manufactured by investment casting. The process comprises of first creating a first model in exact detail out of sculpting wax. This is generally carried out by creating flexible rubber mould of the required design and then injecting a fluid wax to create the original piece. The wax pieces are then attached to a wax pole or sprue to form a wax tree. The said wax tree is then encased in plaster and allowed to cure and dry. After the chunk of plaster has been allowed to dry it is then placed in a hot kiln so the wax piece inside of it can melt and burn out. A hollow void is left in its place, which replicates the wax tree in complete detail. The chunk of plaster with the hollow shape of the wax tree is then it is placed in a centrifugal jewelry casting device that will use centrifugal force to drive molten gold down through an opening in the chunk of plaster where it will fill the hollow spot left by the wax melting out. After it has cooled the plaster is broken open to reveal a piece of gold jewelry.

Since jewelry articles are most often formed of precious metals such as gold or silver, hollow jewelry article with low precious metal content are often desirable since they reduce the cost of the final product. Hollow jewelry articles are also light in weight and more acceptable particularly for earrings, necklaces etc.

One method of producing such hollow jewelry is by electroforming. The process comprises fabricating the metal part by depositing a layer of the desired metal over a base form or substrate which is subsequently removed. The substrate may be suitable removed by chemical treatment leaving only the thin metal layer behind. Examples of such processes have been described in U.S. Pat. Nos. 5,172,568 and 4,343,684. The main disadvantage with the technique is that it requires special equipment designed for electroforming. Electroforming also places design limitation on the article since it may be difficult to produce narrow recesses and sharp angles. Articles manufactured by this process also lack sufficient tensile strength to withstand any external stress.

Use of acid or water soluble wax inserts in mold cavities to mold partially or completely hollow articles is another method used for the reduction of production costs by reducing the amount of precious metal in the end product. Generally. the process comprises placing a soluble wax core insert in a mold cavity and injecting molten plastiwax into the cavity which surrounds the soluble core insert. The core insert is then removed by chemical treatment to produce a plastiwax mold having a hollow core. The said mold is then sent for investment casting to obtain the precious metal gold jewelry. A primary disadvantage of this process is that any accidental change alignment of the core insert or the shifting of the core insert in the mold can cause damage to the shape and size of the article. Attempts have been made to ensure no changes in the alignment take place. For ex. U.S. Pat. No. 5,606,873 discloses use of spacer pins to hold the mold in place and to maintain a prescribed clearance between the wax core insert and the mold cavity.

U.S. Pat. No. 6,554,052 provides a method or process for fabricating a hollow jewelry article which is hollowed or bored out to an arcuate extent of 200°.

There is a continuing need to develop a process for preparing hollow jewelry which is economical, simple and efficient for large volume production of hollow jewelry articles which posses sufficient tensile strength.

In view of the foregoing, it is an object of the present invention to provide an improved process for producing jewelry articles manufactured with a reduced amount of precious metal thereby decreasing the cost of producing jewelry articles capable of withstanding external stress.

DESCRIPTION

Jewelry articles in accordance with the invention include personal adornments worn for ornament or utility including but not limited to rings, earrings, chains, necklaces, pendants, bangles, bracelets, anklets and the like.

The present invention relates to a process for fabricating partially or fully hollow jewelry article; the said process comprising forming at least two wax portions of predetermined dimensions; joining the wax portions to form a wax model and finally casting the wax replica/model into a partially or fully hollow jewelry article. First the wax pieces of predetermined shape and sizes depending on the design of the jewelry article are separately manufactured. The wax portions are then assembled together and joined in a manner so as to obtain a partial or fully hollow cavity. In a preferred embodiment of the present invention, the internal cavity so formed has a shape consistent with the external shape of the jewelry article.

The wax pieces may be joined using one or more materials selected from wax or an adhesive material. In a preferred embodiment of the invention the wax portions are joined together by melting a wax material.

The wax model so obtained may additionally comprise one or more holes which aid in the casting process. Optionally, the wax mold obtained by the aforesaid process may comprise one or more openings adapted to receive a plurality of gem stones.

The wax mold so obtained is then subject to casting to obtain the partially or fully hollow jewelry article. Casting may be performed by one or more processes selected from but not limiting to die casting injection molding, forging, sand casting, permanent-mold casting, centrifugal casting, investment casting, shell casting, or the like. In a preferred embodiment of the present invention, the casting is performed by investment casting.

While the inventors do not wish to restrict the shape of the jewelry articles manufactured by the above mentioned process, in a preferred embodiment of the invention, the jewelry article manufactured by the aforesaid process have an oval, round or marquise shaped cross section extending from 40% to 100% of its length or circumference comprising an inner hollow cavity extending from 40% to 100% of its length. In one embodiment of the present invention, the hollow jewelry article retains the cross sectional shape through the length of the hollow. In another embodiment, the cross section of the hollow article may take a different in shape and/or size through the length of the hollow. The article so manufactured may be partially or completely hollow. (FIGS. 5 to 7).

It is to be noted that the preferred embodiments disclosed in the specification and the accompanying drawings are not limiting the present invention; and that any process; construction, or characteristics that is same or similar to that of the present invention should fall within the scope of the purposes and claims of the present invention.

BRIEF DESCRIPTION OF THE DRAWINGS

FIG. 5 (A) shows a jewelry article having a circular cross section (11) terminating into a rectangular cross section (12). A cross section of an article in Fig A may be partially hollow as indicated in FIG. 5 (B).

FIG. 5 (C) shows a jewelry article which maintains a circular hollow through the length of the article. A cross section of the jewelry article may be completely hollow as shown in FIG. 5 (D).

Similar examples of embodiments that retain their shape through the length of the article and jewelry articles which change its shape when extending from one end to the other are disclosed in FIGS. 6(A), 6(B), 6(C), 6 (D) 7(A), 7(B).

Figure 1A:
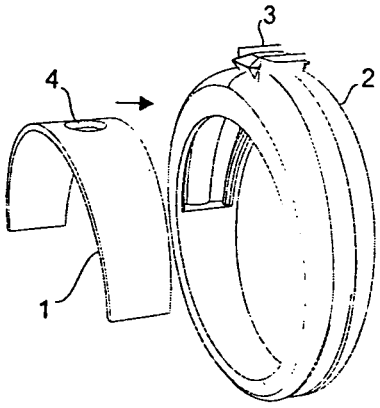
FIG. 1 (A) & FIG. 1 (B) show a perspective view of wax mold of a ring comprising two wax portions 1 and 2 as shown in Fig A (A) that can be attached together to form a complete ring mold. The said mold may comprise an opening for receiving a gem stone (3) and one or more holes (4) which aid the casting process.
Figure 1B:
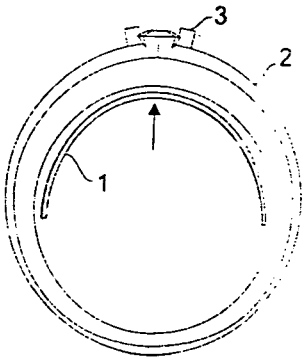
Figure 2A:
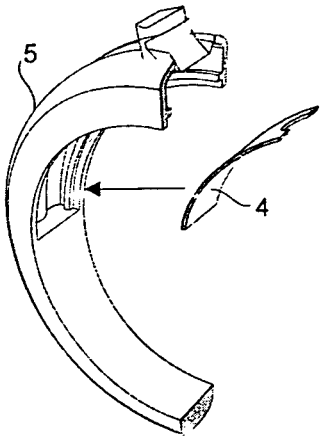
FIG. 2 (A), (B) & (C) show a perspective view of a cross section of a wax mold. Wax portions 5 and 4 are joined at 7 and 6 respectively to form a cavity (20). A gem stone (8) can be fixed to the wax mold in the opening 3.
Figure 2B:
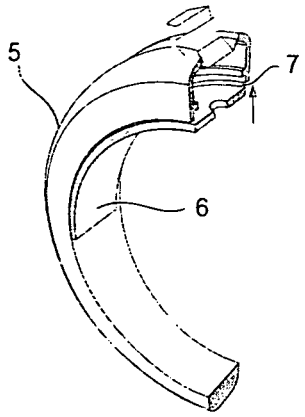
Figure 2C:
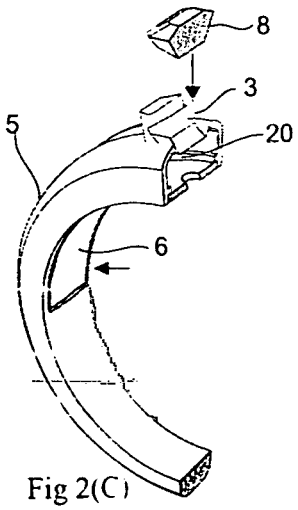
Figure 3A:
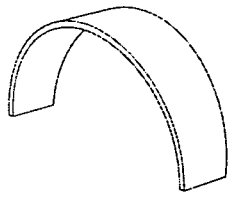
FIGS. 3 (A), (B), (C) & (D) show a wax portion with openings as indicated.
Figure 3B:
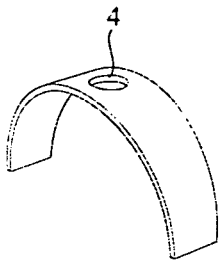
Figure 3C:
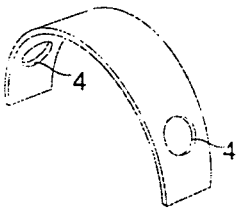
Figure 3D:
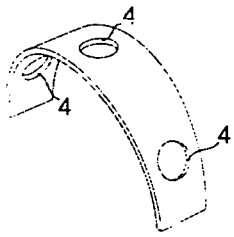
Figure 4A:
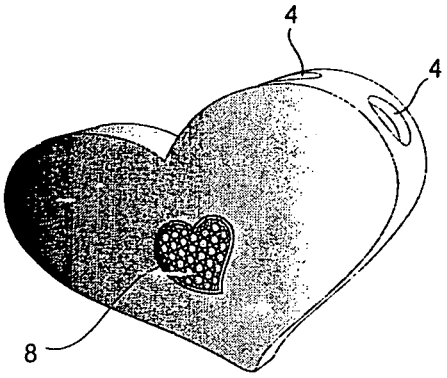
FIGS. 4 (A), (B) & (C) show a heart shaped pendant 8 formed by a wax mold formed by joining a wax portion (9) comprising holes (4) and a wax portion (10) to form a cavity through the inner side of the pendant.
Figure 4B:
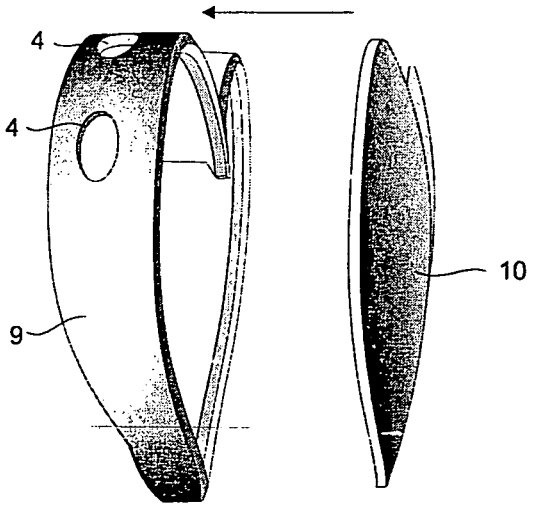
Figure 4C:
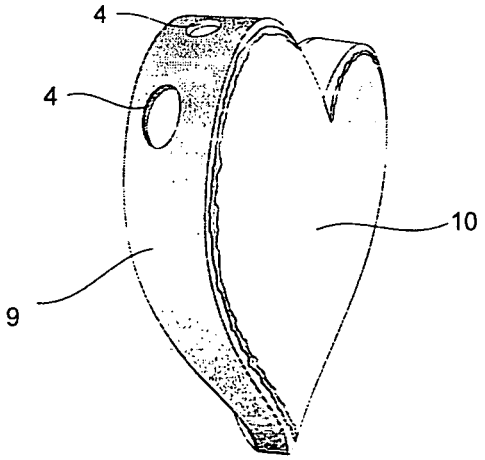
Figure 5A:
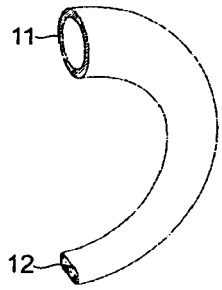
FIGS. 5 to 7 show various perspective and cross sectional views of jewelry articles formed by the process as claimed in the invention.
Figure 5B:
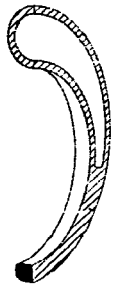
Figure 5C:
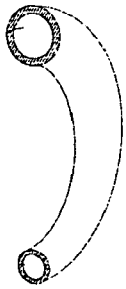
Figure 5D:
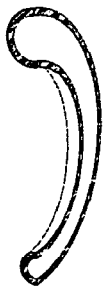
Figure 6A:
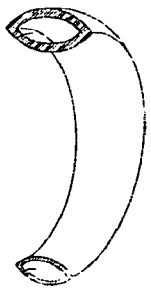
Figure 6B:
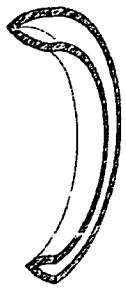
Figure 6C:
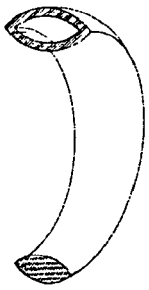
Figure 6D:
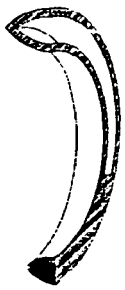
Figure 7A:
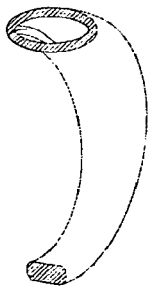
Figure 7B:
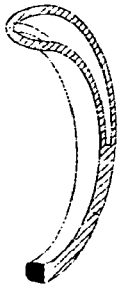
Figure 7C:
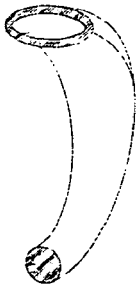
Figure 7D:
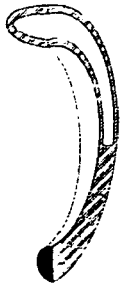

FIGS. 5(C), 6(C) and 7(C) show embodiments of the present invention which are completely hollow while FIGS. 5(D), 6(D) and 7(D) show embodiments which are partially hollow.

I claim:

1. A process for fabricating a partially or fully hollow jewelry article; said process comprising the steps of:

a) forming at least two wax portions of predetermined dimensions, a first wax portion of the at least two wax portions being a partially or fully hollow outer ring portion, and a second portion of the at least two wax portions being an inner curved portion having a half-circle shape and configured to correspond to an opening of a hollow area of the first wax portion;

b) joining the at least two wax portions to form a wax model such that the second wax portion is flush with a corresponding surface of the first wax portion and covers the hollow area of the first wax portion, thereby forming a cavity in the wax model, wherein the at least two wax portions are joined by using one or more materials selected from wax or adhesive material;

c) casting the wax model into a partially or fully hollow jewelry article.

2. A process as claimed in claim 1 wherein the casting is performed by one or more processes selected from die casting injection molding, forging, sand casting, permanent-mold casting, centrifugal casting, lost wax investment casting, shell casting.

3. A process as claimed in claim 2 wherein casting is performed by lost wax investment casting.

4. A process as claimed in claim 1 wherein the wax portions comprise one or more holds.

5. A process as in claim 1 wherein the wax model comprises an internal cavity having a shape consistent with an external shape of jewelry article.

6. A process in claim 1 wherein the wax model comprises one or more openings adapted to receive a plurality of gem stones.

* * * * *